United States Patent [19]

Jackson et al.

[11] Patent Number: 4,765,006

[45] Date of Patent: Aug. 23, 1988

[54] ENCLOSURE FOR CONVERTING A BED INTO A PLAY AREA

[76] Inventors: Randall D. Jackson; Sue A. Jackson, both of 404 Dayton St., Yellow Springs, Ohio 45387

[21] Appl. No.: 66,389

[22] Filed: Jun. 25, 1987

[51] Int. Cl.[4] ..... A47C 21/00; A47G 5/00

[52] U.S. Cl. ..... 5/508; 5/512; 5/DIG. 1; 446/478; 446/488

[58] Field of Search ..... 5/1 R, 93 R, 93 B, 97, 5/99 C, 100, 425, 427, 508, 512, DIG. 1; 446/476, 478, 488

[56] References Cited

U.S. PATENT DOCUMENTS

| | | | |
|---|---|---|---|
| 2,608,726 | 9/1952 | Olson | 446/478 X |
| 3,188,661 | 6/1965 | Rudy | 5/97 |
| 3,498,587 | 3/1970 | Friedberg | 5/512 X |
| 4,523,418 | 6/1985 | McLaughlin | 446/478 X |

*Primary Examiner*—Michael F. Trettel

*Attorney, Agent, or Firm*—Biebel, French & Nauman

[57] ABSTRACT

The conversion of a conventional bed, such as a child's bed, into a play area is accomplished by means of a free-standing enclosure composed of two sub-assemblies of paperboard, each comprising a center panel proportioned to span the width of the bed and a pair of fragmentary side panels hingedly connected to the ends of the center panel. The surfaces of these panels may be provided with representations establishing a desired atmospheric or locational theme, e.g. a castle, a fire engine or a military vehicle. Since the enclosure is free-standing, it can be used independently of a bed to provide a play area, and it is also readily collapsed or disassembled into flat component parts for easy storage.

10 Claims, 3 Drawing Sheets

ENCLOSURE FOR CONVERTING A BED INTO A PLAY AREA

BACKGROUND OF THE INVENTION

This invention relates to the conversion of a conventional bed, particularly a child's bed, into a play area by providing the bed with an enclosure which changes its appearance to incorporate a theme conducive to related play activities.

A preliminary search has established that the prior art includes many examples of beds for children which incorporate a particular theme, such as a house (Rudy U.S. Pat. No. 3,188,661 of 1965), a stagecoach (Santine, No. Des. 203,656 of 1966), a Teddy Bear (Thomas, No. Des.216,666 of 1970), a basketball court (Carter, No. Des. 252,599 of 1979), a truck (Rutar, No. Des. 253,259 of 1979 and Sutherland, No. Des. 264,773 of 1982), and a spacecraft (Jao, No. Des. 284,334 of 1986). In all of these patents, however, the structural components which provide the bed with a particular appearance are also structural components of the bed itself or require mechanical combination with structural components of the bed. The present invention is based on a distinctively different concept and/or approach, as discussed in the following section.

BRIEF DESCRIPTION OF THE INVENTION

The primary distinguishing characteristic of the present invention stems from the concept of starting with a conventional bed, which may be of any size or include any type of frame, and providing that bed with an enclosure which is free-standing and self-supporting with respect to the bed, but which converts the appearance of the bed to something entirely different, such for example as a castle, a fire engine, a military vehicle or any of a wide variety of other objects or themes as discussed in more detail below.

The invention places major emphasis on the combination of protection of the child or children playing with an embodiment thereof against physical injury in the course of play, and minimal production cost for a product incorporating the invention.

More specifically, a typical product of the invention comprises a plurality of panels of relatively stiff sheet material, such particularly as paperboard of an overall thickness ranging from 70 points to 100 points in caliber, which are assembled for use into a free-standing enclosure dimensioned to surround a bed of predetermined standard size.

Preferably, these panels compose three-part sub-assemblies, with one panel in one assembly constituting the head wall of the complete enclosure which will stand at the head of the bed, and with one of the panels in the other sub-assembly constituting the corresponding foot wall or foot board of the enclosure. Each of these head and foot wall panels has hinged to each end thereof a side wall panel, and it is particularly convenient for manufacture, storage and shipment purposes if each of these side wall panels has a length equal to one-half the length of the bed which the finished product is designed to enclose.

In use, the two sub-assemblies are set up with the head and foot wall panels at the head and foot ends of a bed, and with the side wall panels extending at right angles therefrom along the sides of the bed. With the side panels of a height which does not exceed the height of the top of a mattress above the floor, a child can have ready access to the top of the mattress, while the use of half-length side wall panels facilitates opening up the enclosure to provide ready access to the bed by a parent for making or changing the bedding.

With the complete enclosure formed of two hinged sub-assemblies as summarized above, each sub-assembly will be free-standing when the side wall panels are turned at substantially right angles to the head or foot panel, even if adjacent partial side panels are not fastened together. Improved rigidity in the enclosure as a whole, however, is readily achievable by providing releasable fastening means between the ends of the partial side panels, such as Velcro fastening strips or the like. Thus the product of the invention can be used independently of a bed, to define an enclosed play space.

A specific purpose of the invention is to provide an enclosure-defining product as outlined above from board material which is specially adapted for the reproduction thereon of graphics representing any desired environment or theme. Achievement of this objective is promoted by producing each product from a smooth material such as paperboard which offers large flat areas whereon desired graphics can be printed directly or can be laminated after offset printing on paper or plastic sheet.

In a preferred embodiment of the invention, the graphics will substantially cover all areas of the enclosure which are visible when it is surrounding the bed, including the inside surface of the headboard panel and whatever inside surfaces project above the level of the top of the mattress. Also, whatever side panels are intended to be opened may be provided with graphics representing appropriate portions of the subject matter theme of the enclosure as a whole, as more fully discussed hereinafter in connection with the drawings.

The invention accordingly makes it possible and practical to incorporate with its enclosures graphics presenting any desired theme, e.g. nature, religious and educational themes. It is also possible and practical to provide enclosures in accordance with the invention having blank spaces on which users can reproduce themes of their own choice, by means such as stickers or marking pens, and for such purposes, the panels should be coated or covered with a washable material.

Other objects and advantages of the invention will be pointed out in or apparent from the detailed description of one embodiment of the invention which follows.

DESCRIPTION OF THE PREFERRED EMBODIMENT

Figure 1:
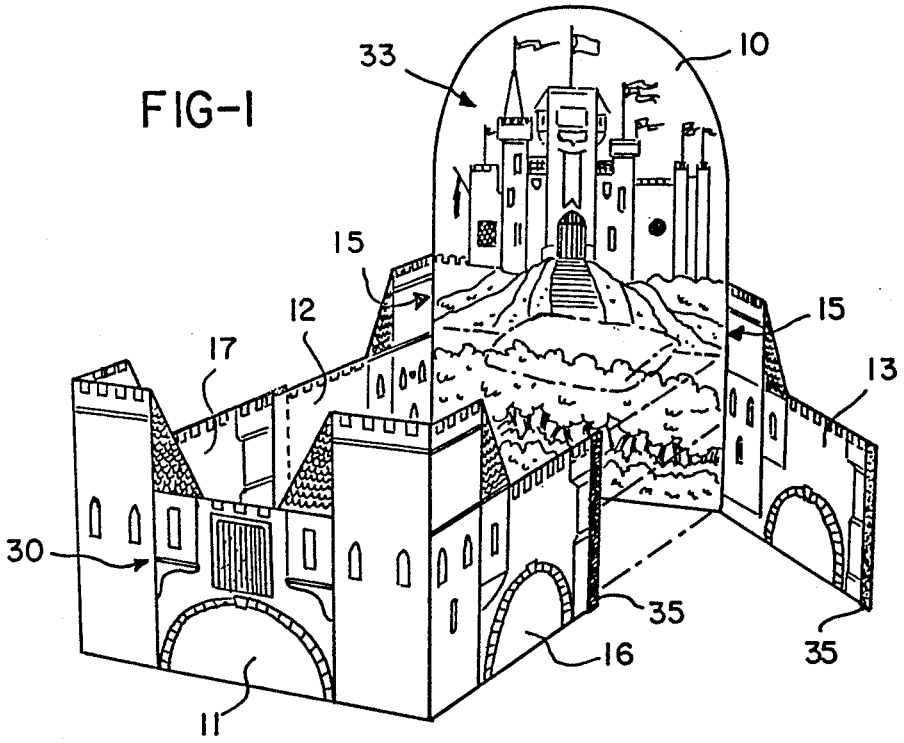
FIG. 1 is a perspective view showing an enclosure in accordance with the invention in assembled position to surround a bed but with the bed omitted.

The embodiment of the invention shown in the drawings comprises a pair of three-panel sub-assemblies, in which the panel 10 is designed to stand at the head end of a conventional bed to serve as the head wall of the enclosure, while the panel 11 constitutes the foot wall portion of the enclosure, each of these panels being of a width dimensioned to span the width of the bed with which they are designed to be used. The remainder of the head wall unit comprises a pair of side panels 12 and 13 hingedly connected at 15 to the opposite edges of the head wall panel 10, and the foot wall panel 11 has an identical pair of side wall panels 16 and 17 hingedly connected at 15 to its side edges.

Figure 2:
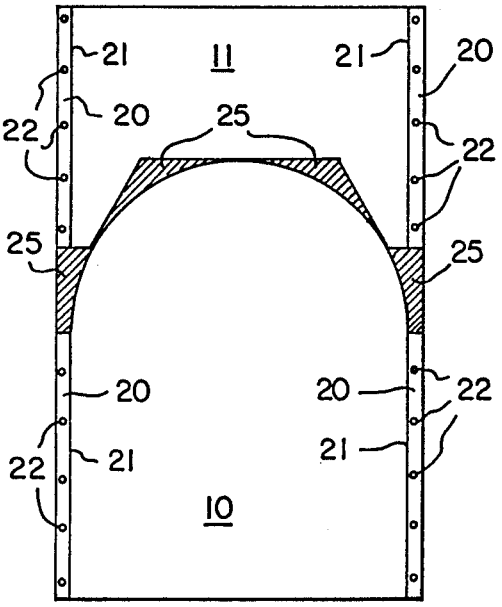
FIG. 2 is a cutting diagram showing how the head and foot wall panels for the enclosure shown in FIG. 1 are cut from a single sheet of paperboard.
Figure 3:
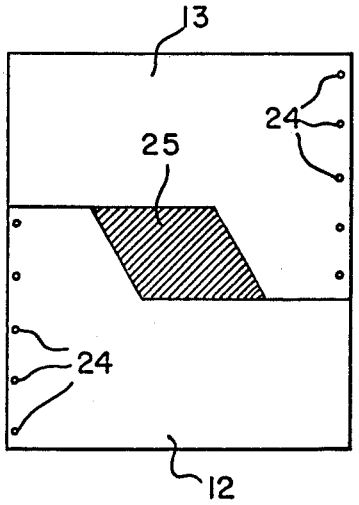
FIG. 3 is a view similar to FIG. 2 showing how two side wall half-panels are cut from a single sheet of paperboard.

The hinged connection 15 between each of the center panels 10 and 11 and each of their associated side panels may be formed in a variety of ways. It is shown as comprising a flap 20 integrally formed along each side edge of each of the center panels 10 and 11 and provided with a score line 21 for ready folding with respect to the adjacent center panel. In FIGS. 2 and 3, each flap 20 is provided with a series of vertically spaced holes 22 for receiving a grommet 23 or other fastener by which the flap is connected, through similar holes 24, with the proper edge of one of the side panels 12, 13, 16 or 17.

Alternatively, the flaps 20 can be provided along one edge of each of the side panels, and any of a variety of other suitable hinge mechanisms could be used. For example, the hinged connection can comprise a strip of flexible sheet plastic adhered along the abutting edges of a pair of panels to form a permanent hinge, or a releasable hinged connection of complementary Velcro strips can be used.

Figure 9:
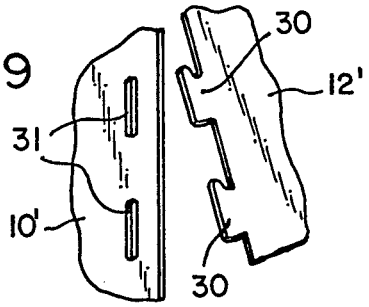
FIG. 9 is a fragmentary exploded view illustrating a tab and slot connection between adjacent panels in accordance with the invention.

Preferably, the selected hinge arrangement should be capable of repeated folding of the side panels into overlying relation with each other and the center panel for storage convenience purposes. However, it is also practical, especially when the panels are made of corrugated board, to use an arrangement as shown in FIG. 9, wherein a series of hook-like tabs 30 on one edge of a panel, preferably a side panel as indicated at 12', fit in complementary slots 31 in a center panel 10'. Such a connection will still provide enough hinged movement of the side panel for ready access to the bed, especially if the tabs 30 are creased where they join the panel 12', but with this type of connection, it would be preferable to separate the panels for storage, to minimize wear on the tabs.

As shown in detail in FIGS. 2 and 3, the head and foot wall panels 10 and 11 can be die cut from a single sheet of board of the desired thickness, and a pair of half-length side panels can be similarly die cut from a single sheet of paperboard or corrugated board. To produce a completed enclosure which will fit around a twin bed of conventional dimensions, each of the head and foot wall panels should be 40 inches wide, with the flaps 20 being 2 inches wide, and with the shaded portions 25 being cut away at the time of blanking the panels.

Similarly in FIG. 3, a pair of side panels can be die cut from a single sheet 40 inches wide, with each of the panels being 18 inches high over the major portion of its length so that this portion will not extend above the level of a conventional twin bed mattress. The castle design shown in FIG. 1, however, is made more realistic by the provision of tower portions at its corners, and the corresponding portion of each side panel can therefore be higher, e.g. 28 inches. For side panels having this dimension, therefore, the sheet from which they are cut should be 46 inches long. These dimensions can of course be varied as needed to fit around beds of other sizes, even including bunk beds.

As discussed hereinabove, the enclosure as whole illustrated in FIG. 1 incorporates a castle theme, and appropriate graphics indicated generally at 33 are therefore reproduced on the outsides of the side and foot panels, and the inside of the head panel. Preferably, however, and especially in order to accomplish the objective of an enclosure which can be used independently of a bed, all of the inside panels as well as the back of the head panel should be provided with graphics appropriate to their location on the inside of the enclosure. Such graphics can be printed directly on the panels, or they can be produced on separate sheets of paper or plastic which are then adhered to the panels.

Enclosures in accordance with the invention have special practical advantages when used in combination with a bed. Not only do they convert the top of the mattress into a play area having a fanciful visual atmosphere, but the several panels provide barriers surrounding the legs and casters of a conventional bed frame and thus minimize the likelihood that a child will be hurt by contact with any such bed frame parts. Also, since the enclosures of the invention are free-standing independently of a bed, they can be used separately from a bed to define an enclosed play space having the particular environmental atmosphere established by the theme of the graphics. Increased versatility can be obtained by the use of coated paperboard having waterproof qualities for outdoor use.

Figure 4:
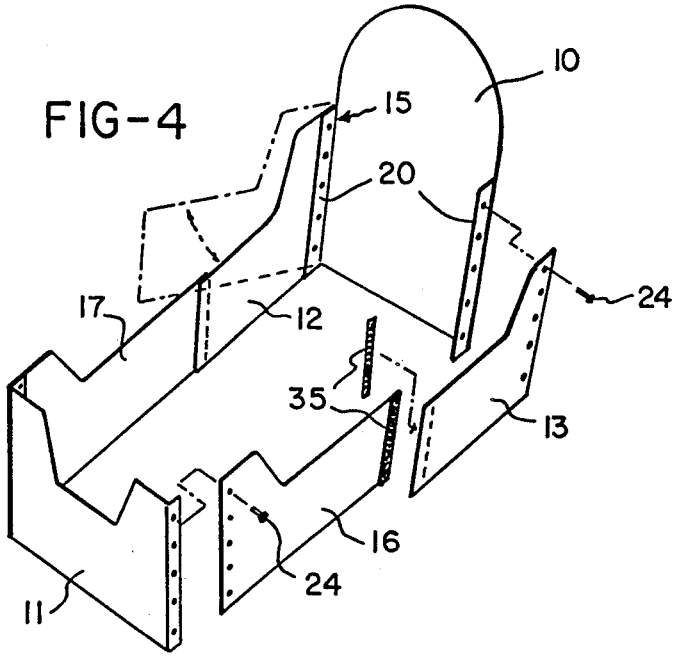
FIG. 4 is an exploded view of the parts of the enclosure shown in FIG. 1.

In view particularly of this field of use for the products of the invention, it is desirable to provide the side panels of each sub-assembly with some readily releasable means for attaching the free ends together. Complementary strips of Velcro material areas indicated at 35 in FIGS. 1 and 4 and are especially useful for this purpose, because of the ease with which a child can fasten and unfasten them, but other mechanisms such as complementary tabs and slots can also be used.

As noted hereinabove, the graphics can represent a wide variety of themes, which are not necessarily limited to an architectural theme or to a particular vehicle, although vehicle themes are particularly well adapted for the purposes of the invention by reason of their similarity in proportions to a standard twin bed. Further, the graphics may represent any of a wide variety of out of door scenes, or perhaps a fort or stockade, especially when the enclosure is intended primarily for use independently of a bed.

Figure 5:
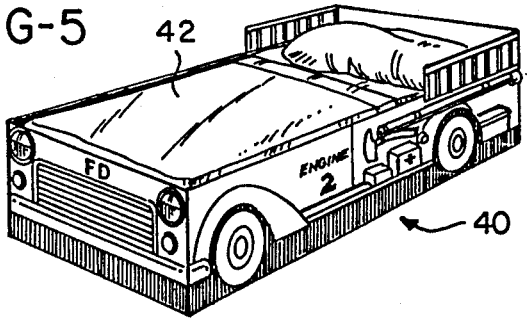
FIGS. 5 and 6 are perspective views showing other embodiments of the invention in enclosing relation with a bed.
Figure 6:
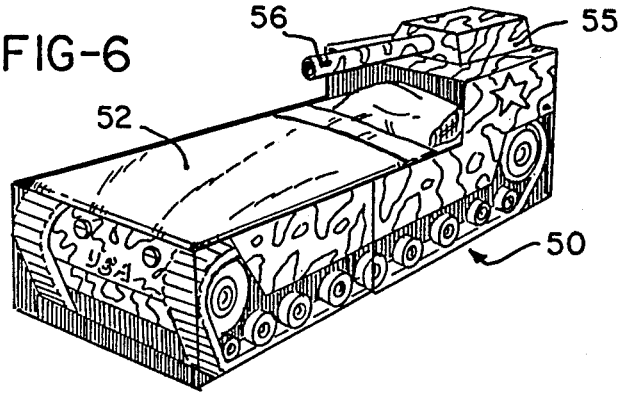

Two examples of other embodiments of the invention are shown in FIGS. 5 and 6 of the suitability for the purposes of the invention of vehicle themes. Thus in FIG. 5, the enclosure 40 is a representation of a fire truck and is shown in surrounding relation with a bed 42. The enclosure 40 is formed the same way as described in connection with FIGS. 1–4, namely of two sub-assemblies each including a head or foot panel and a pair of half side panels.

The embodiment 50 of the invention shown in FIG. 6 is a representation of a mobile machine gun wherein the main components are similarly two sub-panel assemblies corresponding in their structural relation to those already described in connection with FIGS. 1–4 and surrounding a bed 52. The embodiment 50 also includes an upper portion 55 representing the gun barrel 56 and the turret mounting therefor. Such a three dimensional addition to the basic enclosure 50 is also readily fabricated from paperboard and mounted at the head end of the bed by means such as Velcro strips along and inside the junction 57 between the top of the head panel and adjacent portions of the side panels connected thereto.

Figure 7:
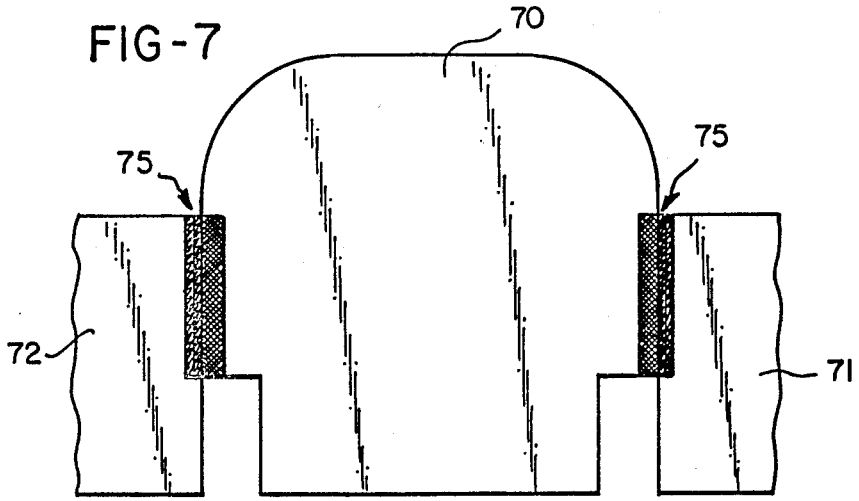
FIGS. 7 and 8 are exploded fragmentary views illustrating modified forms of the head wall panel for a bed enclosure in accordance with the invention.

It is not essential that the head and foot panels of a given enclosure be of a width which fully spans the bed with which the enclosure is designed to be used, so long as at least a portion of each such panel be of such length. For example, FIG. 7 shows a sub-assembly comprising a head panel 70 and side panels 71 and 72 wherein the upper portion of the panel 70 is of sufficient width to span the bed frame, but the lower portion is sufficiently narrower so that it can be fitted between the sides and headboard of the bed to exclude the headboard from the enclosed area. In this form of the invention, therefore, the side panels are hingedly connected to the upper, wider portion of the center panel 70 by Velcro strips 75.

Figure 8:
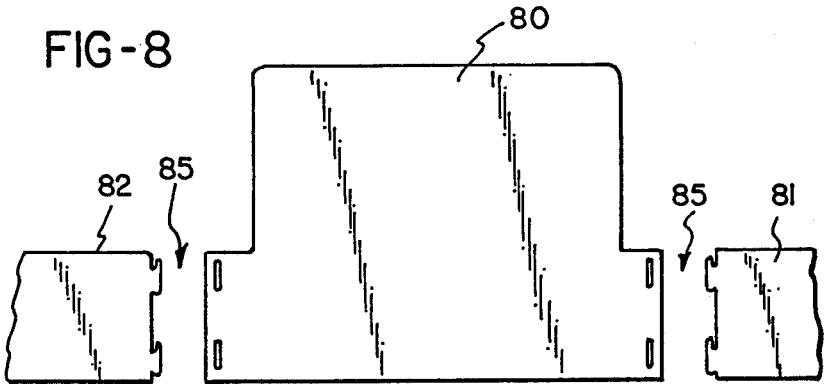

FIG. 8 shows a somewhat different arrangement wherein the head panel 80 includes a lower portion of a width which will span the complete bed frame, but with the upper portion being somewhat less wide, as may be desirable to suit a particular design theme. Either of these arrangements as disclosed in connection with FIGS. 7 and 8 could also be applied to the center panel of the sub-assembly intended to be positioned at the foot end of a bed. FIG. 8 also illustrates at 85 the tab and slot connection described above in connection with FIG. 9 for connecting panel 80 with side panels 81 and 82.

While the articles herein described constitute preferred embodiments of the invention, it is to be understood that the invention is not limited to these precise articles, and that changes may be made therein without departing from the scope of the invention which is defined in the appended claims.

What is claimed is:

1. A free-standing structure for converting the appearance of a conventional bed of predetermined dimensions, such particularly as a child's bed, into a representation of a predetermined visual theme while providing normal access thereto, comprising (a) a plurality of panels of stiff sheet material proportioned for assembly in end-to-end relation wherein said panels define a rectangular enclosure for surrounding the bed, (b) one of said panels constituting the head wall of said enclosure and including a portion having opposite end edges spaced from each other by a dimension spanning the width of said bed, (c) another of said panels constituting the foot wall of said enclosure and including a portion having opposite end edges spaced from each other by a dimension spanning the width of said bed, (d) each of the others of said panels being hingedly connected to one of said end edges of said head and foot wall panels to constitute the side walls of a free-standing rectangular enclosure, (e) said other panels being dimensioned to extend the length of said bed on each side thereof, (f) at least some of said panels having two-dimensional graphics thereon representing said predetermined theme, (g) the top edges of said panels being configured in corresponding relation with said theme, and (h) certain of said side wall panels having one end thereof free to provide for hinged movement thereof with respect to the one of said head and foot wall panels hingedly connected thereto for opening said enclosure to provide ready access to a bed surrounded thereby.

2. A free-standing structure as defined in claim 1 in combination with a conventional bed of predetermined mattress level as well as length and width, characterized by the fact that a major portion of each of said side wall panels is of a height substantially matching said mattress level.

3. A free-standing structure for converting the appearance of a conventional bed of predetermined dimensions, such particularly as a child's bed, into a representation of a predetermined visual theme while providing normal access thereto, comprising (a) a plurality of panels of stiff sheet material porportioned for assembly in end-to-end relation wherein said panels define a rectangular enclosure for surrounding the bed, (b) one of said panels constituting the head wall of said enclosure and including a portion having opposite end edges spaced from each other by a dimension spanning the width of said bed, (c) another of said panels constituting the foot wall of said enclosure and including a portion having opposite end edges spaced from each other by a dimension spanning the width of said bed, (d) each of the others of said panels being hingedly connected to one of said edges of said head and foot wall panels to constitute the side walls of a free-standing rectangular enclosure, (e) said other panels being dimensioned to extend the length of said bed on each side thereof, (f) at least some of said panels having two-dimensional graphics thereon representing said predetermined theme, (g) the top edges of said panels being configured in corresponding relation with said theme, and (h) at least one of said side walls of said enclosure comprising a pair of panels which have a combined length extending the length of said bed, one of said pair of panels being hingedly connected to said head wall panel and the other of said pair of panels being hingedly connected to said foot wall panel for hinged movement opening said enclosure to provide ready access to a bed surrounded by said enclosure.

4. The structure defined in claim 3 wherein each of said side walls comprises a pair of panels each hingedly connected at one end to the adjacent one of said head and foot wall panels to facilitate collapsing of said structure to essentially flat form for shipment or storage.

5. The structure defined in claim 3 further comprising complementary means on the non-hingedly connected ends of each said pair of side panels for releasably connecting said panel ends together to complete said rectangular enclosure.

6. The structure defined in claim 3 wherein each of said pair of panels is of substantially the same length.

7. A free-standing structure for converting the appearance of a conventional bed of predetermined dimensions, such particularly as a child's bed, while providing normal access thereto, comprising (a) a plurality of essentially flat panels interconnected along intersecting planes to be free-standing with said panels extending generally vertically, (b) said interconnected panels being of predetermined dimensions to define an enclosure surrounding the perimeter of said conventional bed, (c) said panels having two-dimensional surface representations at least on the surfaces thereof facing outwardly of the surrounded bed and the inwardly facing surfaces above the top level of the bed which define a predetermined visual theme, (d) the top edges of said panels being configured in corresponding relation with said theme, (e) said representations and said configured top edges of said panels cooperating to provide an apparent three-dimensional structure surrounding the bed, and (f) at least a portion of one of said panels being movable without disturbing the free-standing nature of said enclosure to provide access to bedding on the bed.

8. The structure in defined in claim 7 further comprising panel means defining a cover for at least a portion of the area surrounded by said structure, and means releasably securing said cover on top of said enclosure.

9. The structure defined in claim 7 wherein said panels are formed of paperboard.

10. The structure defined in claim 7 wherein said panels are formed of corrugated board.

* * * * *